US008360017B2

(12) United States Patent
Scuderi

(10) Patent No.: US 8,360,017 B2
(45) Date of Patent: Jan. 29, 2013

(54) PART-LOAD CONTROL IN A SPLIT-CYCLE ENGINE

(75) Inventor: Stephen Scuderi, Westfield, MA (US)

(73) Assignee: Scuderi Group, LLC, West Springfield, MA (US)

( * ) Notice: Subject to any disclaimer, the term of this patent is extended or adjusted under 35 U.S.C. 154(b) by 477 days.

(21) Appl. No.: 12/750,897

(22) Filed: Mar. 31, 2010

(65) Prior Publication Data

US 2010/0263645 A1 Oct. 21, 2010

Related U.S. Application Data

(60) Provisional application No. 61/170,452, filed on Apr. 17, 2009.

(51) Int. Cl.
*F02B 75/18* (2006.01)

(52) U.S. Cl. ..... 123/70 R; 123/68

(58) Field of Classification Search ..... 123/68, 123/70 R

See application file for complete search history.

(56) References Cited

U.S. PATENT DOCUMENTS

| | | | |
|---|---|---|---|
| 4,548,175 | A | 10/1985 | Kawai et al. |
| 5,205,245 | A | 4/1993 | Flack et al. |
| 5,740,767 | A | 4/1998 | Kaku et al. |
| 2009/0038597 | A1 | 2/2009 | Phillips |

FOREIGN PATENT DOCUMENTS

| | | |
|---|---|---|
| JP | 62131916 | 6/1987 |

*Primary Examiner* — Noah Kamen

(74) *Attorney, Agent, or Firm* — Fildes & Outland, P.C.

(57) ABSTRACT

An engine includes a crankshaft rotatable about a crankshaft axis. A compression piston is slidably received within a compression cylinder and operatively connected to the crankshaft such that the compression piston is operable to reciprocate through an intake stroke and a compression stroke during a single rotation of the crankshaft. An expansion (power) piston is slidably received within an expansion cylinder and operatively connected to the crankshaft such that the expansion piston is operable to reciprocate through an expansion stroke and an exhaust stroke during a single rotation of the crankshaft. At least two crossover passages interconnect the compression and expansion cylinders. Each of the at least two crossover passages includes a crossover compression (XovrC) valve and a crossover expansion (XovrE) valve operable to define a pressure chamber therebetween. The engine controls and maximizes engine efficiency at part-load by utilizing only selected crossover passages.

39 Claims, 5 Drawing Sheets

PART-LOAD CONTROL IN A SPLIT-CYCLE ENGINE

CROSS REFERENCE TO RELATED APPLICATION

This application claims the benefit of U.S. Provisional Application No. 61/170,452, filed Apr. 17, 2009.

TECHNICAL FIELD

The present invention generally relates to controlling and maximizing the efficiency of a split-cycle engine operating under part-load conditions.

BACKGROUND OF THE INVENTION

For purposes of clarity, the term "conventional engine" as used in the present application refers to an internal combustion engine wherein all four strokes of the well-known Otto or Diesel cycles (the intake, compression, expansion and exhaust strokes) are contained in each piston/cylinder combination of the engine. Each stroke requires one half revolution of the crankshaft (180 degrees crank angle (CA)), and two full revolutions of the crankshaft (720 degrees CA) are required to complete the entire Otto or Diesel cycle in each cylinder of a conventional engine.

Also, for purposes of clarity, the following definition is offered for the term "split-cycle engine" as may be applied to engines disclosed in the prior art and as referred to in the present application.

A split-cycle engine generally includes:

a crankshaft rotatable about a crankshaft axis;

a compression piston slidably received within a compression cylinder and operatively connected to the crankshaft such that the compression piston is operable to reciprocate through an intake stroke and a compression stroke during a single rotation of the crankshaft;

an expansion (power) piston slidably received within an expansion cylinder and operatively connected to the crankshaft such that the expansion piston is operable to reciprocate through an expansion stroke and an exhaust stroke during a single rotation of the crankshaft; and a crossover passage interconnecting the compression and expansion cylinders, the crossover passage including a crossover compression (XovrC) valve and a crossover expansion (XovrE) valve operable to define a pressure chamber therebetween.

A split-cycle engine replaces two adjacent cylinders of a conventional engine with a combination of one compression cylinder and one expansion cylinder. The four strokes of the Otto or Diesel cycle are "split" over the two cylinders and such that the compression cylinder provides for the intake and compression strokes and the expansion cylinder provides for the expansion and exhaust strokes. The Otto or Diesel cycle is therefore completed in these two cylinders once per crankshaft revolution (360 degrees CA).

U.S. Pat. No. 6,543,225 granted Apr. 8, 2003 to Carmelo J. Scuderi (the "Scuderi patent") and U.S. Pat. No. 6,952,923 granted Oct. 11, 2005 to David P. Branyon et al. (the "Branyon patent") each contain an extensive discussion of split-cycle and similar type engines. In addition, the Scuderi and Branyon patents disclose details of prior versions of engines of which the present invention comprises a further development.

Split-cycle engines typically rely on maintaining pressure in the crossover passage at a high minimum pressure (typically 20 bar or higher) during all four strokes of the Otto or Diesel cycle. Maintaining maximum pressure levels in the crossover passage generally results in the highest efficiency levels.

Also, spark-ignition (or Otto) split-cycle engines preferably maintain an appropriate mixture of air and fuel in the expansion cylinder prior to spark ignition. A stoichiometric air/fuel mixture (approximately 14.7 times the mass of air to fuel) is ideal. A rich mixture (less than approximately 14.7 times the mass of air to fuel) can leave excess fuel, which reduces efficiency. A lean mixture (more than approximately 14.7 times the mass of air to fuel) can produce too much nitrous-oxide (NOx) for a catalytic converter (not shown) to process, causing an unacceptable level of NOx emissions.

In prior art split-cycle engines, the XovrC valves, XovrE valves, and fuel injectors of each of the one or more crossover passages operate synchronously. In other words, if there are multiple crossover passages, the XovrC valves open and close at approximately the same time, the XovrE valves open and close at approximately the same time, and the fuel injectors inject approximately the same amount of fuel into their respective crossover passages at approximately the same time.

Spark-ignition (or Otto) split-cycle engines can control load by varying the mass of air entering the compression cylinder. This can be done by utilizing variable valve actuation of the intake valve, although a throttling valve may also be used. At part-load conditions, the intake valve of the compression cylinder typically closes as compression piston is in its downward stroke (i.e., when the compression piston is moving away from the cylinder head). The result is that the compression cylinder does not intake a full charge of air. In other words, under part-load conditions, the pressure in the compression cylinder when the compression piston is at its bottom dead center position is typically less than 1 atmosphere.

Controlling load by varying the mass of air entering the compression cylinder allows spark-ignition (or Otto) split-cycle engines to maintain an appropriate mixture of air and fuel in the expansion cylinder. However, controlling load in this manner may have adverse effects. In prior art split-cycle engines, compressing less than a full charge of air in the compression cylinder reduces the pressure in the one or more crossover passages because the same mass of air is not moved/compressed into the one or more crossover passages as is moved/compressed at full-load. This of course does not maintain the desired maximum pressure levels in the crossover passages and can reduce the pressure below the aforementioned high minimum pressure requirements of split-cycle engines (typically 20 bar or higher).

Accordingly, there is a need to meet the high minimum pressure requirements of one or more crossover passage of a split-cycle engine at part-load conditions. More particularly, there is a need to maximize the pressure in the one or more crossover passages of spark-ignition split-cycle engines operating at part-load.

SUMMARY OF THE INVENTION

The present invention provides a solution to the aforementioned crossover passage pressure problems for split-cycle engines operating at part-load. In particular, the present invention generally solves these problems by providing multiple crossover passages and, at part-load, utilizing only selected crossover passages that need not be all of the crossover passages.

These and other advantages may be accomplished in an exemplary embodiment of the present invention by providing an engine comprising a crankshaft rotatable about a crankshaft axis, a compression piston slidably received within a compression cylinder and operatively connected to the crankshaft such that the compression piston is operable to reciprocate through an intake stroke and a compression stroke during a single rotation of the crankshaft, an expansion (power) piston slidably received within an expansion cylinder and operatively connected to the crankshaft such that the expansion piston is operable to reciprocate through an expansion stroke and an exhaust stroke during a single rotation of the crankshaft, and at least two crossover passages interconnecting the compression and expansion cylinders, each of the at least two crossover passages including a crossover compression (XovrC) valve and a crossover expansion (XovrE) valve operable to define a pressure chamber therebetween, wherein the compression cylinder is operable to intake a charge of air and compress said charge into at least one but less than all of the at least two crossover passages during a single rotation of the crankshaft.

These and other advantages may be accomplished in a further embodiment of the present invention by providing an engine, comprising a crankshaft rotatable about a crankshaft axis, a compression piston slidably received within a compression cylinder and operatively connected to the crankshaft such that the compression piston is operable to reciprocate through an intake stroke and a compression stroke during a single rotation of the crankshaft, an expansion (power) piston slidably received within an expansion cylinder and operatively connected to the crankshaft such that the expansion piston is operable to reciprocate through an expansion stroke and an exhaust stroke during a single rotation of the crankshaft, and at least two crossover passages interconnecting the compression and expansion cylinders, each of the at least two crossover passages including a crossover compression (XovrC) valve and a crossover expansion (XovrE) valve operable to define a pressure chamber therebetween, wherein the expansion cylinder is operable to receive fluid from at least one but less than all of the at least two crossover passages during a single rotation of the crankshaft.

These and other advantages may be accomplished in a further embodiment of the present invention by providing an engine, comprising a crankshaft rotatable about a crankshaft axis, a compression piston slidably received within a compression cylinder and operatively connected to the crankshaft such that the compression piston is operable to reciprocate through an intake stroke and a compression stroke during a single rotation of the crankshaft, an expansion (power) piston slidably received within an expansion cylinder and operatively connected to the crankshaft such that the expansion piston is operable to reciprocate through an expansion stroke and an exhaust stroke during a single rotation of the crankshaft, at least two crossover passages interconnecting the compression and expansion cylinders, each of the at least two crossover passages including a crossover compression (XovrC) valve and a crossover expansion (XovrE) valve operable to define a pressure chamber therebetween, and at least two fuel injectors, each fuel injector corresponding to one of the at least two crossover passages, each fuel injector operable to add fuel to the exit end of the corresponding crossover passage, wherein the engine is operable to add fuel to the exit end of at least one but less than all of the at least two crossover passages during a single rotation of the crankshaft.

Optionally, in these three embodiments the expansion cylinder may be operable to receive fluid from at least one but less than all of the at least two crossover passages during a single rotation of the crankshaft. The compression cylinder may be operable to intake a charge of air and compress the charge into at least one but less than all of the at least two crossover passages during a single rotation of the crankshaft. The volume of a first of the at least two crossover passages may be between 40 and 60 percent of the volume of a second of the at least two crossover passages. The engine may be configured such that the pressure of the charge in the compression cylinder is less than 1 atmosphere when the compression piston is at its bottom dead center position.

These and other advantages may be accomplished in a further embodiment of the present invention by providing a method for controlling an engine at part-load, the engine including a crankshaft operable to rotate about a crankshaft axis of the engine, a compression piston slidably received within a compression cylinder and operatively connected to the crankshaft such that the compression piston is operable to reciprocate through an intake stroke and a compression stroke during a single rotation of the crankshaft, an expansion (power) piston slidably received within an expansion cylinder and operatively connected to the crankshaft such that the expansion piston is operable to reciprocate through an expansion stroke and an exhaust stroke during a single rotation of the crankshaft, and at least two crossover passages interconnecting the compression and expansion cylinders, each of the at least two crossover passages including a crossover compression (XovrC) valve and a crossover expansion (XovrE) valve operable to define a pressure chamber therebetween, the method comprising actuating at least one but less than all of the crossover compression (XorvC) valves during a single rotation of the crankshaft.

These and other advantages may be accomplished in a further embodiment of the present invention by providing a method for controlling an engine at part-load, the engine including a crankshaft operable to rotate about a crankshaft axis of the engine, a compression piston slidably received within a compression cylinder and operatively connected to the crankshaft such that the compression piston is operable to reciprocate through an intake stroke and a compression stroke during a single rotation of the crankshaft, an expansion (power) piston slidably received within an expansion cylinder and operatively connected to the crankshaft such that the expansion piston is operable to reciprocate through an expansion stroke and an exhaust stroke during a single rotation of the crankshaft, and at least two crossover passages interconnecting the compression and expansion cylinders, each of the at least two crossover passages including a crossover compression (XovrC) valve and a crossover expansion (XovrE) valve operable to define a pressure chamber therebetween, the method comprising actuating at least one but less than all of the crossover expansion (XovrE) valves during a single rotation of the crankshaft.

These and other advantages may be accomplished in a further embodiment of the present invention by providing a method for controlling an engine at part-load, the engine including a crankshaft operable to rotate about a crankshaft axis of the engine, a compression piston slidably received within a compression cylinder and operatively connected to the crankshaft such that the compression piston is operable to reciprocate through an intake stroke and a compression stroke during a single rotation of the crankshaft, an expansion (power) piston slidably received within an expansion cylinder and operatively connected to the crankshaft such that the expansion piston is operable to reciprocate through an expansion stroke and an exhaust stroke during a single rotation of the crankshaft, at least two crossover passages interconnecting the compression and expansion cylinders, each of the at least two crossover passages including a crossover compression (XovrC) valve and a crossover expansion (XovrE) valve operable to define a pressure chamber therebetween, and at least two fuel injectors, each fuel injector corresponding to one of the at least two crossover passages, each fuel injector operable to add fuel to the exit end of the corresponding crossover passage, the method comprising adding fuel to the exit end of at least one but less than all of the crossover passages during a single rotation of the crankshaft.

Optionally, in these three embodiments the method may further include the step of determining which of the fuel injectors to use to add the fuel based on at least one of the load and speed of the engine. The method may include the step of determining which of the crossover expansion (XovrE) valves to actuate based on at least one of the load and speed of the engine. The method may include the step of determining which of the crossover compression (XovrC) valves to actuate based on at least one of the load and speed of the engine. The volume of a first of the at least two crossover passages may be between 40 and 60 percent of the volume of a second of the at least two crossover passages. The engine may be configured such that the pressure of the charge in the compression cylinder is less than 1 atmosphere when the compression piston is at its bottom dead center position.

These and other features and advantages of the invention will be more fully understood from the following detailed description of the invention taken together with the accompanying drawings.

BRIEF DESCRIPTION OF THE DRAWINGS

In the drawings:

FIGS. 3 through 10 are cross-sectional top views of a second embodiment of a split-cycle engine according to the present invention.

DETAILED DESCRIPTION OF THE INVENTION

Figure 1:
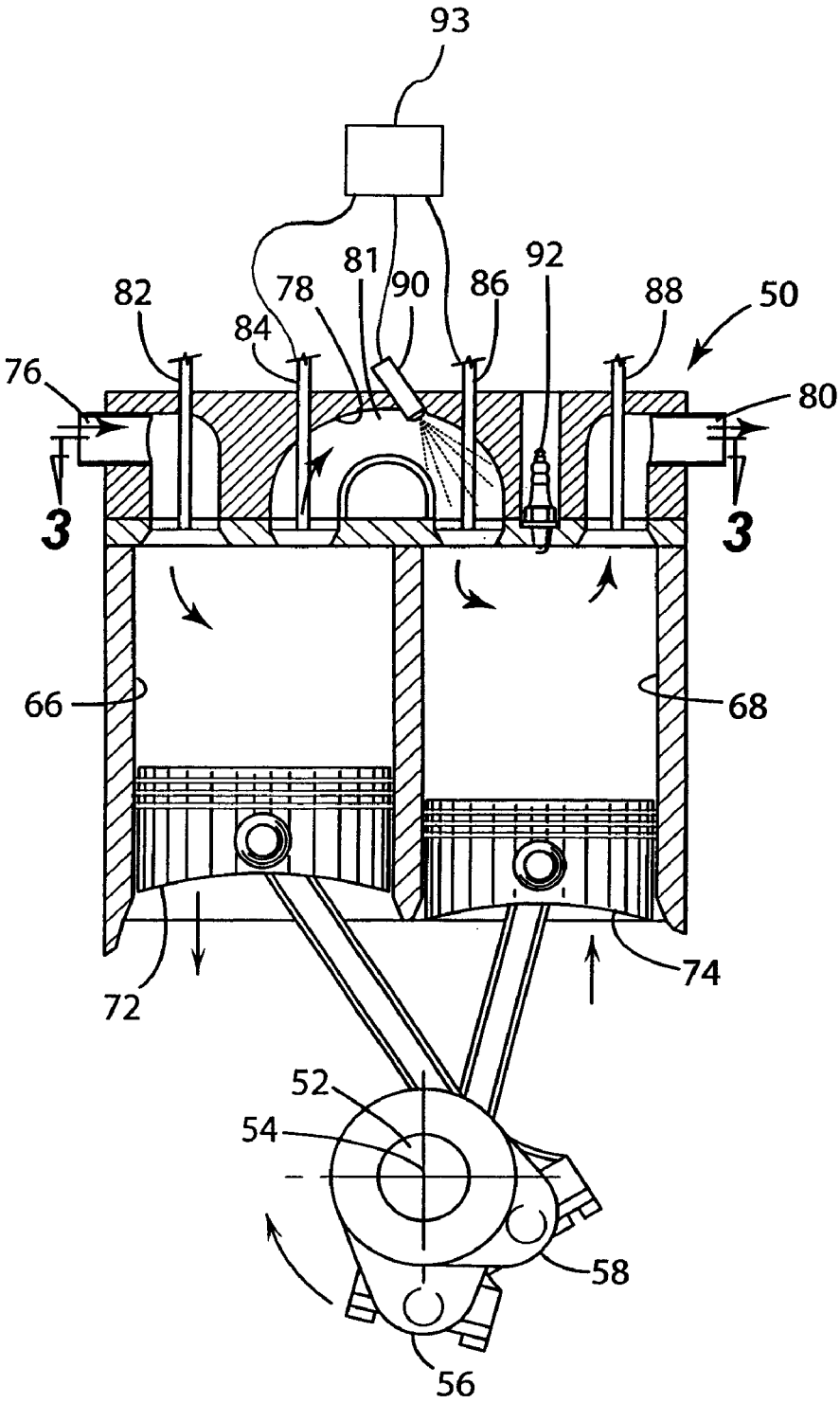
FIG. 1 is a cross-sectional view of a split-cycle engine according to the present invention.

With reference to FIG. 1, numeral 50 generally indicates a split-cycle engine in accordance with the present invention. The split-cycle engine 50 includes a crankshaft 52 rotatable about a crankshaft axis 54. A compression piston 72 is slidably received within a compression cylinder 66 and operatively connected to the crankshaft 52 such that the compression piston is operable to reciprocate through an intake stroke and a compression stroke during a single rotation of the crankshaft. An expansion (power) piston 74 is slidably received within an expansion cylinder 68 and operatively connected to the crankshaft 52 such that the expansion piston is operable to reciprocate through an expansion stroke and an exhaust stroke during a single rotation of the crankshaft. At least two crossover passages 78 interconnect the compression and expansion cylinders 66, 68. Each crossover passage includes a crossover compression (XovrC) valve 84 and a crossover expansion (XovrE) valve 86 operable to define a pressure chamber 81 therebetween.

During the intake stroke, intake air is drawn into the compression cylinder 66 from an intake passage 76 through an inwardly opening (opening inward into the cylinder) poppet intake valve 82. During the compression stroke, the compression piston 72 pressurizes the air charge and drives the air charge through the crossover passages 78, which act as the intake passages for the expansion cylinder 68.

The volumetric compression ratio of the compression cylinder of the split-cycle engine 50 is herein referred to as the "compression ratio" of the split-cycle engine. The volumetric compression ratio of the expansion cylinder of a split-cycle engine is herein referred to as the "expansion ratio" of the split-cycle engine. Due to very high compression ratios (e.g., 40 to 1, 80 to 1, or greater) in the compression cylinder 66, outwardly opening (opening outward away from the cylinder) poppet crossover compression (XovrC) valves 84 at the inlet of each of the one or more crossover passages 78 are used to control flow from the compression cylinder 66 into the one or more crossover passages 78. Due to very high expansion ratios (e.g., 40 to 1, 80 to 1, or greater) in the expansion cylinder 68, outwardly opening poppet crossover expansion (XovrE) valves 86 at the outlet of each of the one or more crossover passages 78 control flow from the one or more crossover passages 78 into the expansion cylinder 68. Generally, the actuation rates and phasing of the XovrC and XovrE valves 84, 86 may be timed to maintain pressure in the one or more crossover passages 78 at a high minimum pressure (typically 20 bar or higher) during all four strokes of the Otto or Diesel cycle.

One or more fuel injectors 90 (one for each crossover passage 78) inject fuel into the pressurized air at the exit end of the one or more crossover passages 78 in correspondence with the XovrE valve(s) 86 opening, which occurs shortly before the expansion piston 74 reaches its top dead center position. The fuel-air charge fully enters the expansion cylinder 68 shortly after the expansion piston 74 reaches its top dead center position. As the expansion piston 74 begins to descend from its top dead center position, and while the XovrE valve(s) 86 is/are still open, the spark plug 92 is fired to initiate combustion (typically between 10 to 20 degrees CA after top dead center of the expansion piston 74). The XovrE valve(s) 86 is/are then closed before the resulting combustion event can enter the one or more crossover passages 78. The combustion event drives the expansion piston 74 downward in a power stroke. Exhaust gases are pumped out of the expansion cylinder 68 into an exhaust passage 80 through an inwardly opening poppet exhaust valve 88 during the exhaust stroke.

With the split-cycle engine concept, the geometric engine parameters (i.e., bore, stroke, connecting rod length, compression ratio, etc.) of the compression and expansion cylinders are generally independent from one another. For example, the crank throws 56, 58 for the compression cylinder 66 and expansion cylinder 68 respectively may have different radii and may be phased apart from one another with top dead center (TDC) of the expansion piston 74 occurring prior to TDC of the compression piston 72. This independence enables the split-cycle engine to potentially achieve higher efficiency levels and greater torques than typical four stroke engines.

First Exemplary Embodiment

Figure 2:
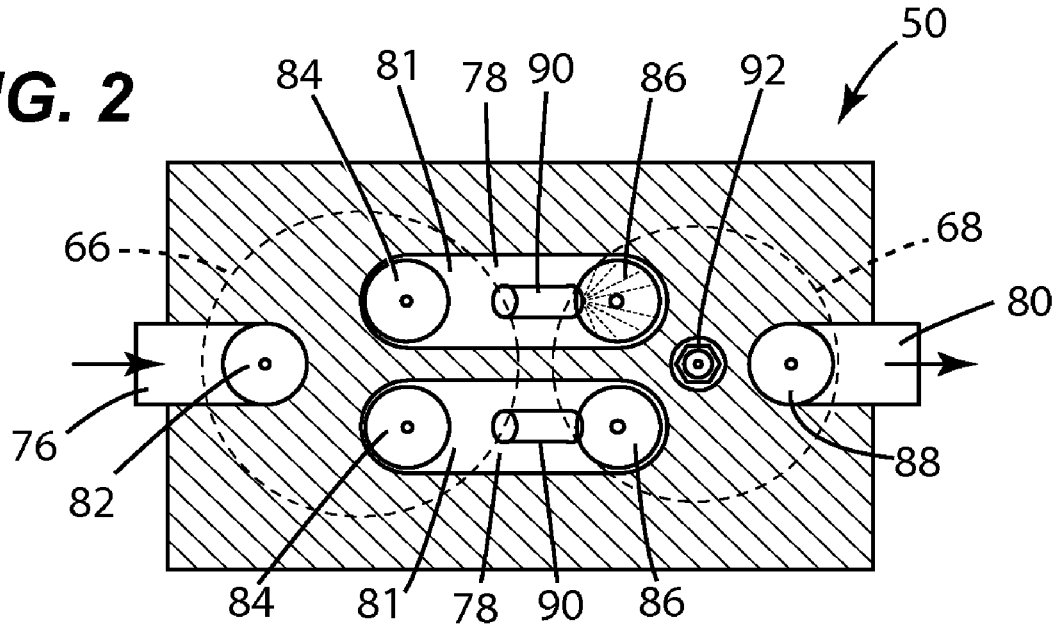
FIGS. 2 and 3 are cross-sectional top views of the split-cycle engine taken along the line 3-3 in FIG. 1.
Figure 3:
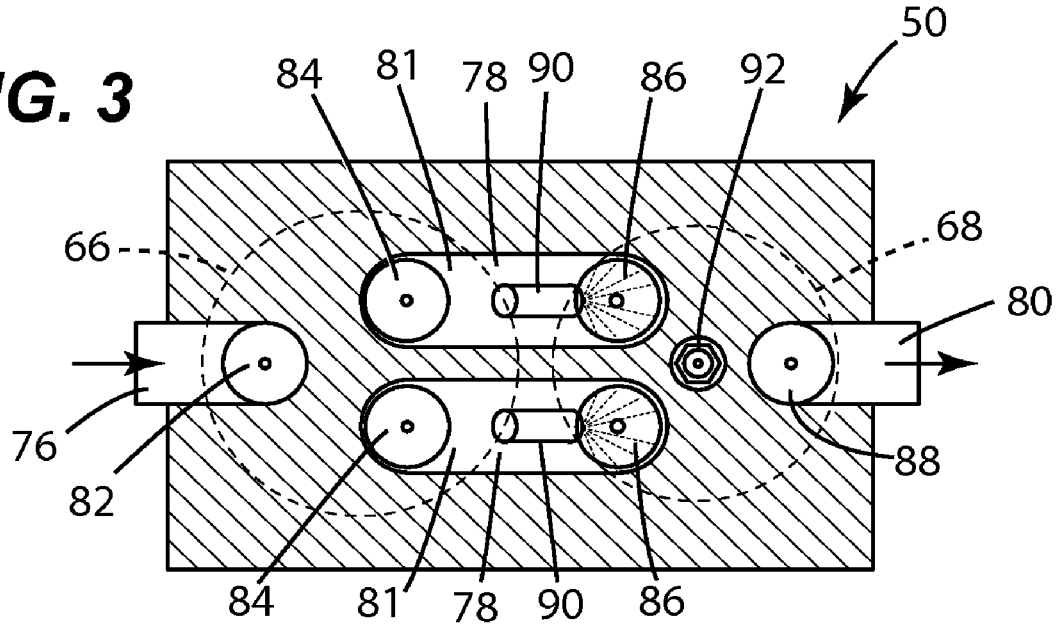

Turning now to FIGS. 2 and 3, a first embodiment in accordance with the present invention provides two crossover passages 78, which are approximately the same volume. The maximum mass of air that each of the crossover passages 78 are designed to process (i.e., input via XovrC 84 or output via XovrE 86) during a single revolution of the crankshaft 52 at a particular engine speed is approximately the same.

At full load, both crossover passages 78 are utilized. This means that during a single rotation of the crankshaft the XovrC valves 84 corresponding to both crossover passages 78 are actuated (i.e., opened and closed), both fuel injectors 90 inject fuel into the exit end of their respective crossover passages 78, and the XovrE valves 86 corresponding to both crossover passages 78 are opened and closed. Such utilization of both crossover passages 78 is depicted in FIG. 3 by both fuel injectors 90 spraying fuel into the exit end of the respective crossover passages 78.

At part-load, the engine 50's electronic control unit (ECU) 93 selects at least one of the crossover passages 78 to utilize. For example, at half-load the compression cylinder intakes (or receives) a mass of air. At half-load, this mass of air can approximately match the maximum mass of air that either one of the crossover passages 78 is designed to process during a revolution of the crankshaft 52. Accordingly, the ECU 93 selects one of the two crossover passages 78 to utilize. Utilization of only one crossover passage 78 is shown in FIG. 2 by only one fuel spray being indicated by dashed lines fanning outwardly from the tip of the fuel injector 90 and toward XovrE valve 86. The crossover passage 78 that is not utilized (shown in FIG. 2 by its corresponding fuel injector 90 not ejecting fuel spray) is deactivated by not actuating both the XovrC valve 84 and the XovrE valve 86 of that crossover passage. Given that the crossover passages 78 are approximately the same size in this embodiment, the aforementioned selection may be based on factors such as what effect previous cycles of the engine 50 have had on the engine. For example, if the engine 50 comprises only two crossover passages 78 of approximately the same size as is the case in this embodiment, it may be advantageous to alternate between utilization of each of the two crossover passages because doing so may be beneficial to wetting of the cylinder walls in the expansion cylinder 68.

Second Exemplary Embodiment

Turning now to FIGS. 4 through 10, a second embodiment in accordance with the present invention provides three crossover passages 94, 96, 98, which each differ in volume. In the embodiment shown in the drawings, the maximum mass of air that the largest crossover passage 94 is designed to process (i.e., input via XovrC 84 and/or output via XovrE 86) during a single revolution of the crankshaft 52 at a particular engine speed may be approximately 4 times a variable X (i.e., 4X). The maximum mass of air that the second smallest (or second largest) crossover passage 96 is designed to process (i.e., input via XovrC 84 and/or output via XovrE 86) during a single revolution of the crankshaft 52 at a particular engine speed may be approximately 2 times a variable X (i.e., 2X). The maximum mass of air that the smallest crossover passage 98 is designed to process (i.e., input via XovrC 84 and/or output via XovrE 86) during a single revolution of the crankshaft 52 at a particular engine speed may be approximately a variable X (i.e., X).

The volumes of the crossover passages 94, 96, 98 in the second embodiment are designed in a binary arrangement to maximize the number of combinations of maximum masses when selecting different combinations of the crossover passages 94, 96, 98. In this second embodiment, there are seven distinct combinations of crossover passages 94, 96, 98 that have distinct maximum masses of air that the combination can process during a single rotation of the crankshaft 52, as shown in Table I below.

TABLE I

Figure 4:
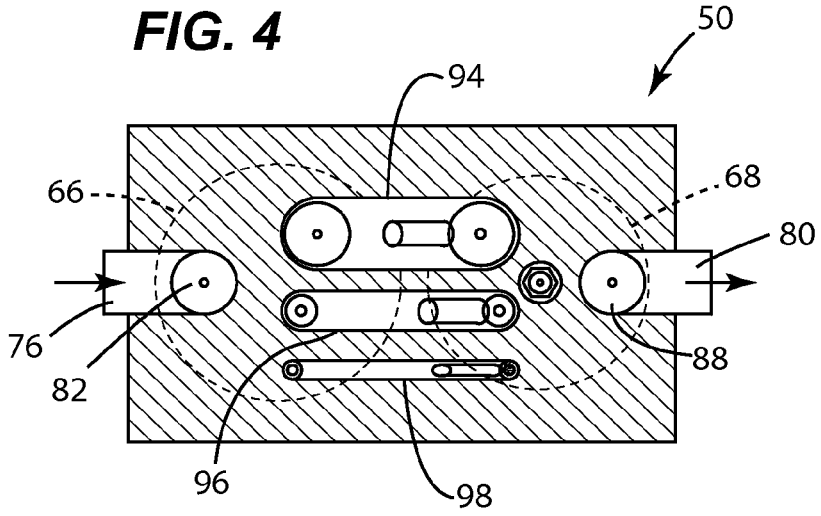
Figure 5:
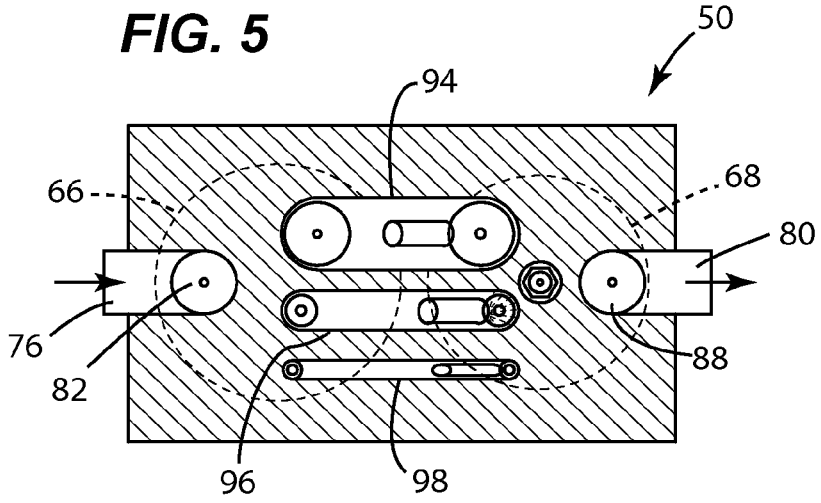
Figure 6:
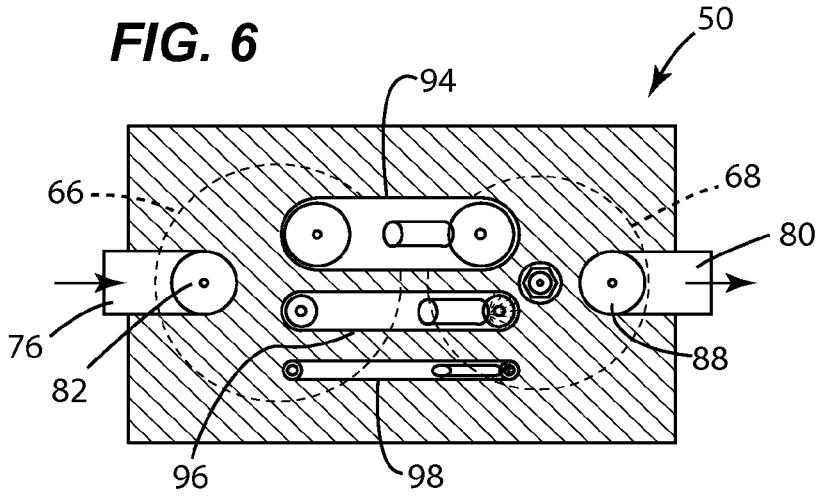

| | Crossover Passage 94 | Crossover Passage 96 | Crossover Passage 98 | Maximum Mass Processable per Crankshaft Revolution |
|---|---|---|---|---|
| FIG. 4 | 0 | 0 | 1 | 1X |
| FIG. 5 | 0 | 1 | 0 | 2X |
| FIG. 6 | 0 | 1 | 1 | 3X |

TABLE I-continued

Figure 7:
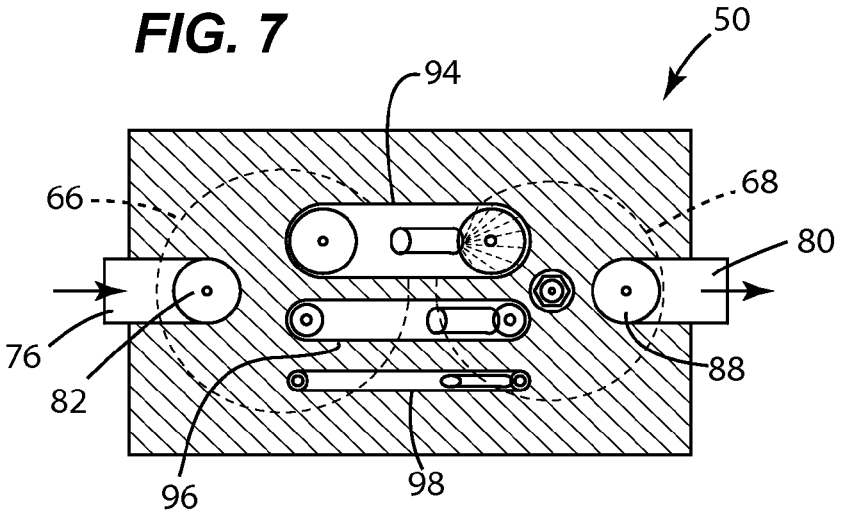
Figure 8:
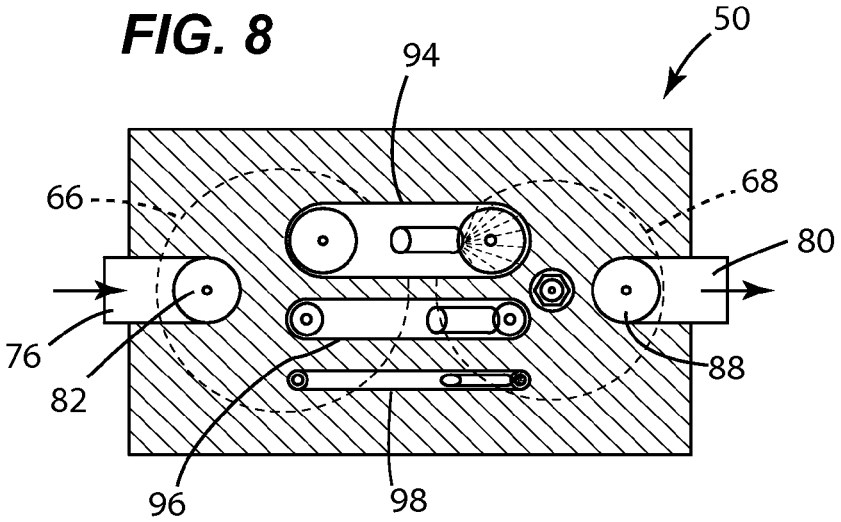
Figure 9:
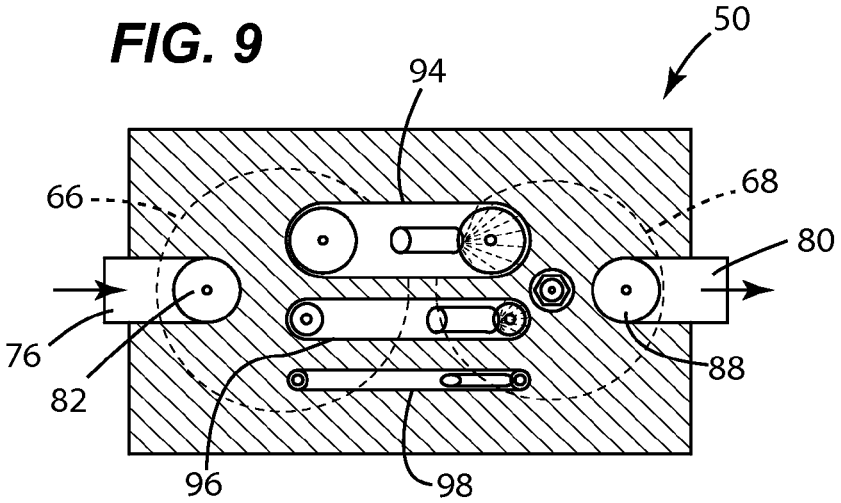
Figure 10:
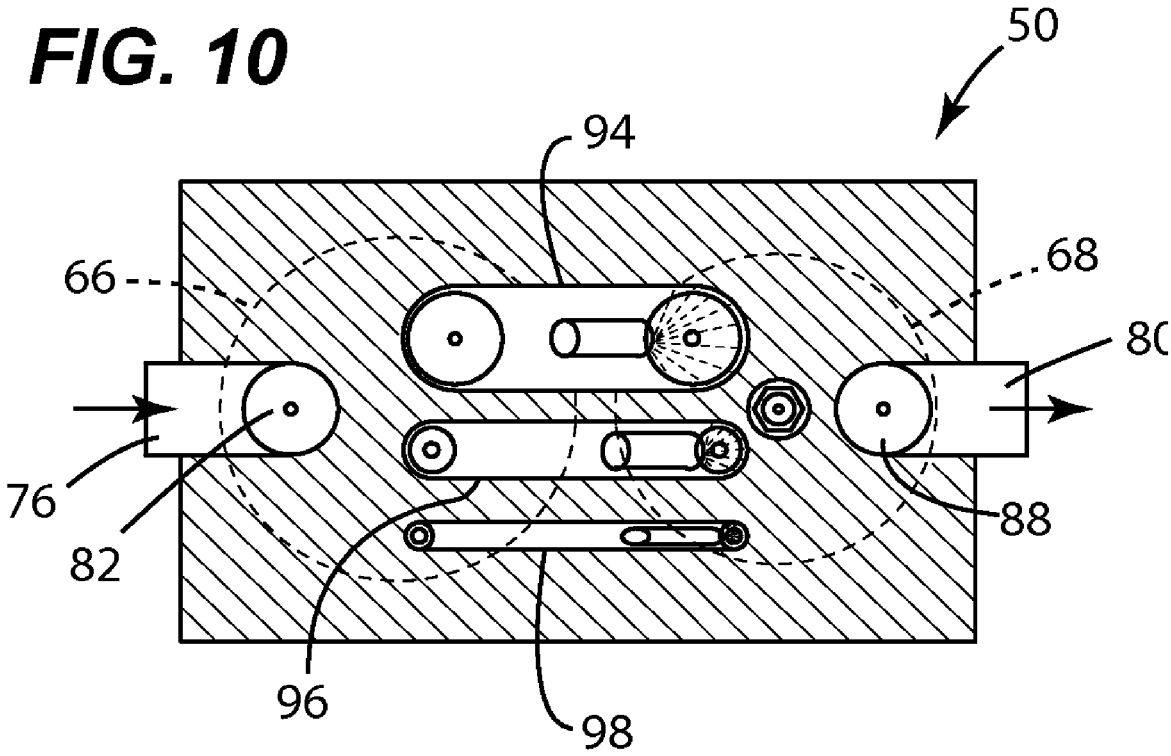

| | Crossover Passage 94 | Crossover Passage 96 | Crossover Passage 98 | Maximum Mass Processable per Crankshaft Revolution |
|---|---|---|---|---|
| FIG. 7 | 1 | 0 | 0 | 4X |
| FIG. 8 | 1 | 0 | 1 | 5X |
| FIG. 9 | 1 | 1 | 0 | 6X |
| FIG. 10 | 1 | 1 | 1 | 7X |

0 = Crossover Passage Not Selected
1 = Crossover Passage Selected

FIG. 4 through 10 show each combination of crossover passages as indicated in the left hand column of Table I. For example, in FIG. 4 only the crossover passage 98 is utilized (as indicated in FIG. 4 by only one fuel spray in crossover passage 98). FIGS. 5 through 10 show the other various combinations of crossover passages 94, 96 98 that can be utilized (each indicated by the fuel sprays in the figures).

Selecting Crossover Passages for the First and Second Embodiments

The engine 50's electronic control unit (ECU) 93 uses the engine load and the speed of the engine to determine which of the multiple crossover passages 78 of the first embodiment or the multiple crossover passages 94, 96, 98 of the second embodiment to utilize (e.g., to compress the air into, inject fuel into, and power the expansion cylinder 68 with) for each revolution of the crankshaft 52. Ideally, the appropriate crossover passages 78 or 94, 96, 98 should be selected (which is not necessarily all of the crossover passages 78 or 94, 96, 98) such that there is no pressure drop in the crossover passages 78 or 94, 96, 98 in comparison to the pressure in the crossover passages 78 or 94, 96, 98 when the engine 10 is operating at full-load. The ideal situation may not always be possible or practical, however the present invention aims to utilize the appropriate crossover passages 78 or 94, 96, 98 (which can be less than all of the crossover passages 78 or 94, 96, 98) such that the pressure drop in the crossover passages 78 or 94, 96, 98 is minimized.

Each crossover passage 78 or 94, 96, 98 is designed to input (or receive) a particular maximum mass of air via its XovrC valve 84 and to output a particular maximum mass of air via its XovrE valve 86 during a single revolution of the crankshaft 52 at a particular engine speed. These two maximum masses for each crossover passage are typically the same value in the first embodiment. In other words, each crossover passage 78 is generally designed to input (or receive) and output the same mass of air during a single rotation of the crankshaft 52 at a particular engine speed. In the second embodiment, each crossover passage 94, 96, 98 is generally designed to input (or receive) and output a multiple of a mass X of air during a single rotation of the crankshaft 52 at a particular engine speed.

The ECU 93 determines the mass of air that the compression cylinder 66 intakes (or receives) during any given intake stroke of the engine 50. The ECU 93 then determines the maximum mass that the crossover passages 78 or 94, 96, 98 can process during a single revolution of the crankshaft 52 based on the speed and load of the engine. The maximum mass that any individual crossover passage 78 or 94, 96, 98 can process during a single revolution of the crankshaft can be pre-programmed into the ECU 93, or alternatively the ECU 93 can calculate these values during operation of the engine 50. In any case, the ECU 93 compares the mass of air that the compression cylinder 66 intakes (or receives) in any given intake stroke with the maximum mass that various different combinations of crossover passages 78 or 94, 96, 98 can process during a single revolution of the crankshaft 52.

Table I shows an exemplary list of crossover passage 94, 96, 98 combinations and maximum masses according to the second embodiment of the present invention. The ECU 93 preferably selects the smallest value in such a list that exceeds the mass of air that compression cylinder 66 intakes (or receives) during the intake stroke of the engine 50. For example, for a mass of air of 4.5 times a variable X (i.e., 4.5X), the ECU 93 would select crossover passages 94 and 98 as shown in FIG. 8 because together crossover passages 94 and 98 can process a maximum mass of 5X during a single revolution of the crankshaft 52. A maximum mass of 5X is the smallest maximum processable mass of air of any combination of crossover passages 94, 96, 98 that exceeds 4.5X.

The split-cycle engine 50 utilizes only the selected crossover passages 78 or 94, 96, 98 (e.g., crossover passages 94, 98 in the above example) during the compression and power strokes of the engine 50 that immediately follow the intake stroke of the engine 50 during which the crossover passages 78 or 94, 96, 98 were selected. This means that only the XovrC valves 84 that correspond to the selected crossover passages 78 are actuated (e.g., opened and/or closed) during the succeeding revolution of crankshaft 52 such that the air compressed by the compression piston 72 is compressed into only the selected crossover passages 78 or 94, 96, 98. Only those fuel injectors 90 that are disposed in the selected crossover passages 78 or 94, 96, 98 are used to inject fuel into the exit end of only the selected crossover passages 78 or 94, 96, 98 during the succeeding revolution of the crankshaft 52. And, only the XovrE valves 86 that correspond to the selected crossover passage 78 are actuated (e.g., opened and/or closed) during the succeeding revolution of the crankshaft 52 in order to allow flow of air/fuel into the expansion cylinder 68 from only the selected crossover passages 78 or 94, 96, 98. The crossover passage(s) that are not selected are deactivated by not actuating both the XovrC valve and the XovrE valve corresponding to the non-selected crossover passage(s).

The above system quantizes the mass of air received by the compression cylinder 66 during a given intake stroke of the split-cycle engine 50 into a set of crossover passages 78 or 94, 96, 98 to utilize in the succeeding compression and power strokes of the split-cycle engine 50 which (1) minimizes the pressure loss in the crossover passages or 94, 96, 98 and (2) maximizes the pressure in the crossover passages 78 or 94, 96, 98. This enables the split-cycle engine to operate under part-load conditions while maintaining a high minimum pressure in its crossover passages 78 or 94, 96, 98.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. An engine, comprising:

a crankshaft rotatable about a crankshaft axis;

a compression piston slidably received within a compression cylinder and operatively connected to the crankshaft such that the compression piston is operable to reciprocate through an intake stroke and a compression stroke during a single rotation of the crankshaft;

an expansion (power) piston slidably received within an expansion cylinder and operatively connected to the crankshaft such that the expansion piston is operable to reciprocate through an expansion stroke and an exhaust stroke during a single rotation of the crankshaft;

at least two crossover passages interconnecting the compression and expansion cylinders, each of the at least two crossover passages including a crossover compression (XovrC) valve and a crossover expansion (XovrE) valve operable to define a pressure chamber therebetween; and an electronic control unit (ECU) that controls actuation of the crossover compression (XovrC) valves and the crossover expansion (XovrE) valves to selectively utilize the at least two crossover passages;

wherein the compression cylinder is operable at part-load to intake a charge of air and compress said charge into at least one but less than all of the at least two crossover passages during a single rotation of the crankshaft.

2. The engine of claim 1, wherein the expansion cylinder is operable at part-load to receive fluid from at least one but less than all of the at least two crossover passages during a single rotation of the crankshaft.

3. The engine of claim 1, further comprising:

at least two fuel injectors, each fuel injector corresponding to one of the at least two crossover passages, each fuel injector operable to add fuel to the exit end of the corresponding crossover passage;

wherein the engine is operable at part-load to add fuel to the exit end of at least one but less than all of the at least two crossover passages during a single rotation of the crankshaft.

4. The engine of claim 1, wherein the volume of one of the at least two crossover passages is between 40 and 60 percent of the volume of another of the at least two crossover passages.

5. The engine of claim 1, configured such that the pressure of the charge in the compression cylinder is less than 1 atmosphere when the compression piston is at its bottom dead center position.

6. An engine, comprising:

a crankshaft rotatable about a crankshaft axis;

a compression piston slidably received within a compression cylinder and operatively connected to the crankshaft such that the compression piston is operable to reciprocate through an intake stroke and a compression stroke during a single rotation of the crankshaft;

an expansion (power) piston slidably received within an expansion cylinder and operatively connected to the crankshaft such that the expansion piston is operable to reciprocate through an expansion stroke and an exhaust stroke during a single rotation of the crankshaft;

at least two crossover passages interconnecting the compression and expansion cylinders, each of the at least two crossover passages including a crossover compression (XovrC) valve and a crossover expansion (XovrE) valve operable to define a pressure chamber therebetween;

an electronic control unit (ECU) that controls actuation of the crossover compression (XovrC) valves and the crossover expansion (XovrE) valves to selectively utilize the at least two crossover passages;

wherein the expansion cylinder is operable at part-load to receive fluid from at least one but less than all of the at least two crossover passages during a single rotation of the crankshaft.

7. The engine of claim 6, wherein the compression cylinder is operable at part-load to intake a charge of air and compress said charge into at least one but less than all of the at least two crossover passages during a single rotation of the crankshaft.

8. The engine of claim 6, further comprising:

at least two fuel injectors, each fuel injector corresponding to one of the at least two crossover passages, each fuel injector operable to add fuel to the exit end of the corresponding crossover passage;

wherein the engine is operable at part-load to add fuel to the exit end of at least one but less than all of the at least two crossover passages during a single rotation of the crankshaft.

9. The engine of claim 6, wherein the volume of one of the at least two crossover passages is between 40 and 60 percent of the volume of another of the at least two crossover passages.

10. The engine of claim 6, configured such that the pressure of the charge in the compression cylinder is less than 1 atmosphere when the compression piston is at its bottom dead center position.

11. An engine, comprising:

a crankshaft rotatable about a crankshaft axis;

a compression piston slidably received within a compression cylinder and operatively connected to the crankshaft such that the compression piston is operable to reciprocate through an intake stroke and a compression stroke during a single rotation of the crankshaft;

an expansion (power) piston slidably received within an expansion cylinder and operatively connected to the crankshaft such that the expansion piston is operable to reciprocate through an expansion stroke and an exhaust stroke during a single rotation of the crankshaft;

at least two crossover passages interconnecting the compression and expansion cylinders, each of the at least two crossover passages including a crossover compression (XovrC) valve and a crossover expansion (XovrE) valve operable to define a pressure chamber therebetween;

at least two fuel injectors, each fuel injector corresponding to one of the at least two crossover passages, each fuel injector operable to add fuel to the exit end of the corresponding crossover passage; and an electronic control unit (ECU) that controls actuation of the crossover compression (XovrC) valves, the crossover expansion (XovrE) valves, and the at least two fuel injectors to selectively utilize the at least two crossover passages;

wherein the engine is operable at part-load to add fuel to the exit end of at least one but less than all of the at least two crossover passages during a single rotation of the crankshaft.

12. The engine of claim 11, wherein the compression cylinder is operable at part-load to intake a charge of air and compress said charge into at least one but less than all of the at least two crossover passages during a single rotation of the crankshaft.

13. The engine of claim 11, wherein the expansion cylinder is operable at part-load to receive fluid from at least one but less than all of the at least two crossover passages during a single rotation of the crankshaft.

14. The engine of claim 11, wherein the volume of one of the at least two crossover passages is between 40 and 60 percent of the volume of another of the at least two crossover passages.

15. The engine of claim 11, configured such that the pressure of the charge in the compression cylinder is less than 1 atmosphere when the compression piston is at its bottom dead center position.

16. A method for controlling an engine at part-load, the engine including a crankshaft operable to rotate about a crankshaft axis of the engine, a compression piston slidably received within a compression cylinder and operatively connected to the crankshaft such that the compression piston is operable to reciprocate through an intake stroke and a compression stroke during a single rotation of the crankshaft, an expansion (power) piston slidably received within an expansion cylinder and operatively connected to the crankshaft such that the expansion piston is operable to reciprocate through an expansion stroke and an exhaust stroke during a single rotation of the crankshaft, and at least two crossover passages interconnecting the compression and expansion cylinders, each of the at least two crossover passages including a crossover compression (XovrC) valve and a crossover expansion (XovrE) valve operable to define a pressure chamber therebetween, the method comprising:

actuating at least one but less than all of the crossover compression (XorvC) valves during a single rotation of the crankshaft.

17. The method of claim 16, further comprising determining which of the crossover compression (XovrC) valves to actuate based on at least one of the load and speed of the engine.

18. The method of claim 16, further comprising actuating at least one but less than all of the crossover expansion (XovrE) valves during a single rotation of the crankshaft.

19. The method of claim 18, further comprising determining which of the crossover expansion (XovrE) valves to actuate based on at least one of the load and speed of the engine.

20. The method of claim 16, wherein the engine further comprises at least two fuel injectors, each fuel injector corresponding to one of the at least two crossover passages, each fuel injector operable to add fuel to the exit end of the corresponding crossover passage, the method further comprising:

adding fuel to the exit end of at least one but less than all of the crossover passages during a single rotation of the crankshaft.

21. The method of claim 20, further comprising determining which of the fuel injectors to use to add the fuel based on at least one of the load and speed of the engine.

22. The method of claim 16, wherein the volume of one of the at least two crossover passages is between 40 and 60 percent of the volume of another of the at least two crossover passages.

23. The method of claim 16, wherein the engine is configured such that the pressure of the charge in the compression cylinder is less than 1 atmosphere when the compression piston is at its bottom dead center position.

24. A method for controlling an engine at part-load, the engine including a crankshaft operable to rotate about a crankshaft axis of the engine, a compression piston slidably received within a compression cylinder and operatively connected to the crankshaft such that the compression piston is operable to reciprocate through an intake stroke and a compression stroke during a single rotation of the crankshaft, an expansion (power) piston slidably received within an expansion cylinder and operatively connected to the crankshaft such that the expansion piston is operable to reciprocate through an expansion stroke and an exhaust stroke during a single rotation of the crankshaft, and at least two crossover passages interconnecting the compression and expansion cylinders, each of the at least two crossover passages including a crossover compression (XovrC) valve and a crossover expansion (XovrE) valve operable to define a pressure chamber therebetween, the method comprising:

actuating at least one but less than all of the crossover expansion (XovrE) valves during a single rotation of the crankshaft.

25. The method of claim 24, further comprising determining which of the crossover expansion (XovrE) valves to actuate based on at least one of the load and speed of the engine.

26. The method of claim 24, further comprising actuating at least one but less than all of the crossover compression (XorvC) valves during a single rotation of the crankshaft.

27. The method of claim 26, further comprising determining which of the crossover compression (XovrC) valves to actuate based on at least one of the load and speed of the engine.

28. The method of claim 24, wherein the engine further comprises at least two fuel injectors, each fuel injector corresponding to one of the at least two crossover passages, each fuel injector operable to add fuel to the exit end of the corresponding crossover passage, the method further comprising:

adding fuel to the exit end of at least one but less than all of the crossover passages during a single rotation of the crankshaft.

29. The method of claim 28, further comprising determining which of the fuel injectors to use to add the fuel based on at least one of the load and speed of the engine.

30. The method of claim 24, wherein the volume of one of the at least two crossover passages is between 40 and 60 percent of the volume of another of the at least two crossover passages.

31. The method of claim 24, wherein the engine is configured such that the pressure of the charge in the compression cylinder is less than 1 atmosphere when the compression piston is at its bottom dead center position.

32. A method for controlling an engine at part-load, the engine including a crankshaft operable to rotate about a crankshaft axis of the engine, a compression piston slidably received within a compression cylinder and operatively connected to the crankshaft such that the compression piston is operable to reciprocate through an intake stroke and a compression stroke during a single rotation of the crankshaft, an expansion (power) piston slidably received within an expansion cylinder and operatively connected to the crankshaft such that the expansion piston is operable to reciprocate through an expansion stroke and an exhaust stroke during a single rotation of the crankshaft, at least two crossover passages interconnecting the compression and expansion cylinders, each of the at least two crossover passages including a crossover compression (XovrC) valve and a crossover expansion (XovrE) valve operable to define a pressure chamber therebetween, and at least two fuel injectors, each fuel injector corresponding to one of the at least two crossover passages, each fuel injector operable to add fuel to the exit end of the corresponding crossover passage, the method comprising:

adding fuel to the exit end of at least one but less than all of the crossover passages during a single rotation of the crankshaft.

33. The method of claim 32, further comprising determining which of the fuel injectors to use to add the fuel based on at least one of the load and speed of the engine.

34. The method of claim 33, further comprising determining which of the crossover expansion (XovrE) valves to actuate based on at least one of the load and speed of the engine.

35. The method of claim 32, further comprising actuating at least one but less than all of the crossover compression (XorvC) valves during a single rotation of the crankshaft.

36. The method of claim 35, further comprising determining which of the crossover compression (XovrC) valves to actuate based on at least one of the load and speed of the engine.

37. The method of claim 32, further comprising actuating at least one but less than all of the crossover expansion (XovrE) valves during a single rotation of the crankshaft.

38. The method of claim 32, wherein the volume of one of the at least two crossover passages is between 40 and 60 percent of the volume of another of the at least two crossover passages.

39. The method of claim 32, wherein the engine is configured such that the pressure of the charge in the compression cylinder is less than 1 atmosphere when the compression piston is at its bottom dead center position.

* * * * *